US005803884A

United States Patent [19]

Sharp

[11] Patent Number: 5,803,884

[45] Date of Patent: Sep. 8, 1998

[54] ABDOMINAL EXERCISE MACHINE WITH CURVED BACK SUPPORT

[76] Inventor: Gary Owen Sharp, 1320 Cherry Ave., Columbus, Ga. 31902

[21] Appl. No.: 276,038

[22] Filed: Jul. 15, 1994

Related U.S. Application Data

[63] Continuation of Ser. No. 917,195, Jul. 22, 1992, abandoned.

[51] Int. Cl.[6] ..... A61F 5/00

[52] U.S. Cl. ..... 482/142; 482/907; 482/148; 297/382

[58] Field of Search ..... 482/148, 55, 907, 482/142, 92, 133, 140, 114; 297/383, 460, 423.811, 337, 354.12

[56] References Cited

U.S. PATENT DOCUMENTS

| | | | |
|---|---|---|---|
| 2,117,821 | 3/1938 | Parker | 297/459 |
| 3,762,769 | 10/1973 | Poschl | 297/460 |
| 4,867,142 | 9/1989 | Jones | 482/907 |
| 5,100,131 | 3/1992 | Fong | 482/112 |

FOREIGN PATENT DOCUMENTS

| | | | |
|---|---|---|---|
| 724580 | 2/1955 | United Kingdom | 297/383 |

*Primary Examiner*—Jerome Donnelly
*Attorney, Agent, or Firm*—Needle & Rosenberg

[57] ABSTRACT

The present invention provides an abdominal exercise apparatus having an adjustable curved back support. The machine is used to produce an exercise that isolates, stretches, works, and develops the muscles of the abdominal wall (abs). The machine positions and supports the body to prevent it from unfolding at the hips, eliminating use of the thigh flexors and pain they cause from the exercise. Then it arches the back, which in turn extends the abs fully. In a preferred embodiment, the tension of extension of the abs is adjustable through positioning of back support.

3 Claims, 3 Drawing Sheets

ABDOMINAL EXERCISE MACHINE WITH CURVED BACK SUPPORT

CROSS-REFERENCE TO RELATED APPLICATIONS

The present application is a continuation of Ser. No. 07/917,195, filled Jul. 22, 1992, now abandoned.

BACKGROUND OF THE INVENTION

1. Field of the Invention

The present invention is a piece of exercise apparatus. In particular, the present invention provides an exercise machine and an exercise to isolate, stretch, work, and develop the muscles of the abdominal walls (the abs).

2. Description of Relative Art

The muscles of the abdominal wall are responsible for so many functions, their condition will dominate the condition of the entire body. They are the muscles that surround and support the abdominal cavity, which is where the organs that store and digest the food are located. Once the abs are stretched the abdominal cavity enlarges, motivating one to eat more food than needed to satisfy the "full" feeling sensation. Food in excess of what is required for the body to function is not wasted, rather it is turned into fat and stored throughout the entire body. It takes energy to convert it into fat and strength and energy to carry the resultant excess weight. All this is at the cost of the individual's physical performance.

The trunk of the body is the platform from which the chest, shoulders, and arms work. The abs are the flexors of the spine and as such, they pull the trunk forward, twist it to the right or left, and pull the shoulders down on either side. Their size, strength, and condition determines the range and ease of movement through that range the upper body can be moved and is a major factor in the quality of an individual's physical performance.

The muscles of the abdominal wall supply more than half the structural integrity of the trunk of the body. More important than the load carrying ability is the fact that these muscles protect the back from stress and shock. Without the structural integrity produced by the abs, the back will be subjected to loads greater than its capability, and it will have little protection from shock or impact.

The muscles of the abdominal wall also contribute to the endurance of an individual, as these muscles assist the diaphragm in exhausting spent air from the lungs.

These are some of the roles of the abs used to impress the importance of these muscles to the health and physical performance of an individual.

The abdominal muscles surround the abdominal cavity, connecting the rib cage and vertebral column to the pelvic girdle. These four broad, flattened muscles are arranged in layers making up the anterior and lateral walls of the abdomen.

The roles of the abs are to decrease the size of the abdominal cavity, increase the pressure on the contents of the abdominal cavity, press the air out of the lungs during forceful exhalation, work as flexors of the spine, twist the body via the spine, aid the body in defecation, urination, and vomiting, and, in women, aid in child birth.

The number of aspects in which the abs are involved in, means that in order to have a healthy body, or to function at the higher levels of physical performance, the abs must be strong, tight and capable of working through their full range of motion. Notwithstanding their importance, there has been no efficient way to develop the abs.

This lack of means to develop the abs is because the abs are one of two muscle groups of the trunk of the body. The second muscle group is the thigh flexors. The thigh flexors are made up of two muscles, whose role is to bring the thigh forward folding the body at the hips. Previous exercises work the trunk as a single muscle group, i.e., they fail to isolate the abs so they can be worked in a manner to redevelop them.

By way of example, the previous sit-up exercise works the full trunk. In the sit-up exercise, the person performing the sit-up lays with his back flat on the floor, knees bent, and feet secured by some means. The upper body is raised with the body folding at the hips. In this exercise, it is the muscles of the thigh flexors that are worked, as the thigh flexors are the muscles which fold the body. The abs do not fold the body, so any work they perform is secondary to the work performed by the thigh flexors. The majority of the energy exerted in performing the sit-up exercise will be used in working the thigh flexors, and the effort will cease when the thigh flexors are fatigued.

Another negative aspect of the previous sit-up exercise is how the thigh flexors are attached. They run from the top of the thigh bone, across the top of the pelvis, to the lumbar region of the spine (the lower back). Being attached so low in the back, lifting the weight of the upper body causes great stress on the lower back, and that stress often leads to the pain which one experiences in performing sit-ups. If the individual has a back injury, or if the individual is very large, this pain will limit, if not cancel, the effort.

As the abs are not the dominant muscle worked in the sit-up exercise, and as the muscles worked cause pain in the people that need it the most, sit-ups are a poor abdominal exercise.

A second previous basic abdominal exercise is the crunch. In performing the crunch, a person lays with his back on the floor, with his legs raised and supported, and with his knees bent at an angle of about ninety degrees. The abs are contracted, raising the head and shoulders off the floor as the abs pull to a crunched position. The back is not brought off the floor when performing a crunch. While the crunch exercise does isolate the abs and all the effort exerted is directed to their development, there is the limited range of motion. The movement is from back flat on the floor to the crunch position, i.e., less than half the possible range of motion of the abs.

This lack of range of motion when performing crunches will be most noticeable in the larger person. Thus, the ones who have the greatest need for the exercise are the ones who benefit the least from its performance.

Most previous abdominal exercises involve variations of the sit-up and the crunch. As such, they continue to maintain the flaws of those two exercises. The flaws of many exercises designed to work the abs come about as a result of their failure to isolate the abs, their failure to stretch the abs, their failure to work the abs through their full range of motion, their failure to eliminate the strain on the lower back, and the fact that they work the muscles at a single resistance level.

Traditional abdominal exercises will produce hard muscles, but unless they stretch and work the abdominal's full range of motion, the muscles full physical potential will not be developed. To develop the full physical potential of a muscle, it must be stretched and worked through its full range of motion.

Another limitation of known abdominal exercises is that they do not work the abs in conjunction with the upper body.

Without balancing upper body strength with development of the abdominal muscles, the body's full physical potential is not developed and there is a greater possibility of injury caused by the stronger body part compromising the weaker body part. An example of this is when the upper body lifts a weight that causes a backache.

As described above, a major aspect of a healthy body is a set of well developed abs. Working the extremities will burn calories to eliminate fat, but if the abs are not developed, the hunger developed can nullify the benefit. The present invention involves direct exercise of the abs, through their fullest range of motion, at the highest level of intensity within the individuals ability, for an extended duration of time. The ability to direct the effort toward working the abs will produce greater results with less effort then any prior approach. Furthermore, the safety and quality of the results make the present method a viable way to develop the foundation of condition necessary to develop the full physical potential of the body.

SUMMARY OF THE INVENTION

With the forgoing in mind, the present invention provides a piece of exercise apparatus which was designed to develop the full physical potential of the abs. In one aspect of the invention, the invention is comprised of a substantially horizontal seat which is mounted on a frame assembly. The invention includes a curved seat back which preferably includes means which enable the seat back to be adjustably raised and lowered. In a preferred embodiment, the curved portion of the seat back support is padded. The frame preferably includes means for adjusting the angle between the seat back support and the seat.

Use of the apparatus results in the performance of the inventive method described herein. In use, an individual sits on the seat and slides back until the small of the lower back comes into contact and is supported by the curved back support, preventing the body from unfolding at the hip. Thus, the thigh flexors are not required in the exercise. Taking the thigh flexors out of the effort eliminates the strain and pain they produce.

In performing the exercise of the present invention, the upper body is lowered onto the curved back support whereupon the user's back is arched and supported. Arching the back causes the abdominal muscles to be extended. The force lowering the body is gravity, with the control of movement produced by the eccentric contraction of the abdominal muscles. The upper body will continue to lower till the abs have been fully extended. The tension of the extended position is adjustable through the adjustment of the curved back support, which has a wide range of adjustments in the preferred embodiment of the invention. In the full up position of the curved back support, the full extension of the abdominal muscles is produced with a minimal resistance. In the full down position of the curved back support, the body goes lower so the full extension of the abdominal muscles is produced with a greater resistance. This results in a greater challenge to work the muscles harder. This adjustability allows use of the proper resistance to work the abdominal muscles to their full potential regardless the strength of the individual.

DETAILED DESCRIPTION OF THE PREFERRED EMBODIMENTS

Figure 1:
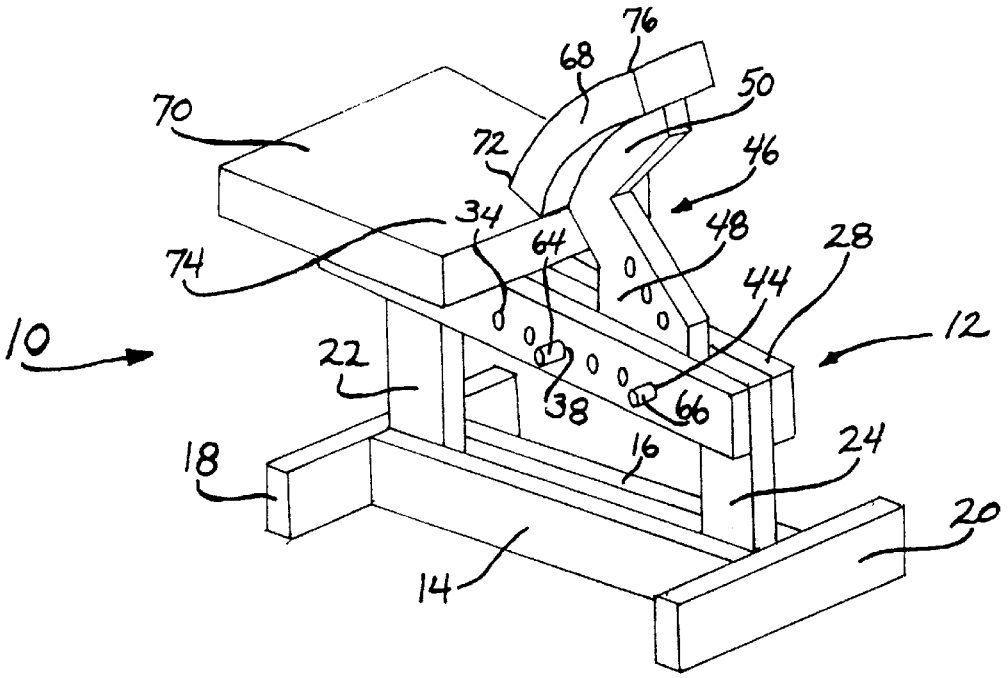
FIG. 1 is an isometric view of the apparatus of the present invention.

Referring first to FIGS. 1–6, the apparatus 10 of the present invention is a machine that enables a user to isolate, stretch, work, and develop the muscles of the abdominal wall. As shown, the apparatus 10 is comprised of a base frame assembly 12 (See FIGS. 1–3). In a preferred embodiment of the invention the base frame assembly 12 is comprised of a pair of lower base members 14,16 which attach to a front end member 18 and a rear end member 20. As shown, the middle portion of the front end member 18 is attached to the front portions of the lower base members 14, 16, and the rear end member 20 is attached to the rear portions of the lower base members 14, 16.

In a preferred embodiment of the invention, when the lower base members 14, 16 are attached to the end members 18, 20, sufficient space is left between the lower base members 14, 16 to permit the installation of a front vertical support 22 and rear vertical support 24. As shown, the front vertical support 22 is somewhat longer than the rear vertical support 24 in order to have the upper portion of the base frame assembly slope downward from front to rear, as this makes the apparatus 10 more comfortable to sit on and use. A pair of back support assembly mounting members 26, 28 are attached to the vertical supports 22, 24, as illustrated in FIGS. 1–3.

Figure 2:
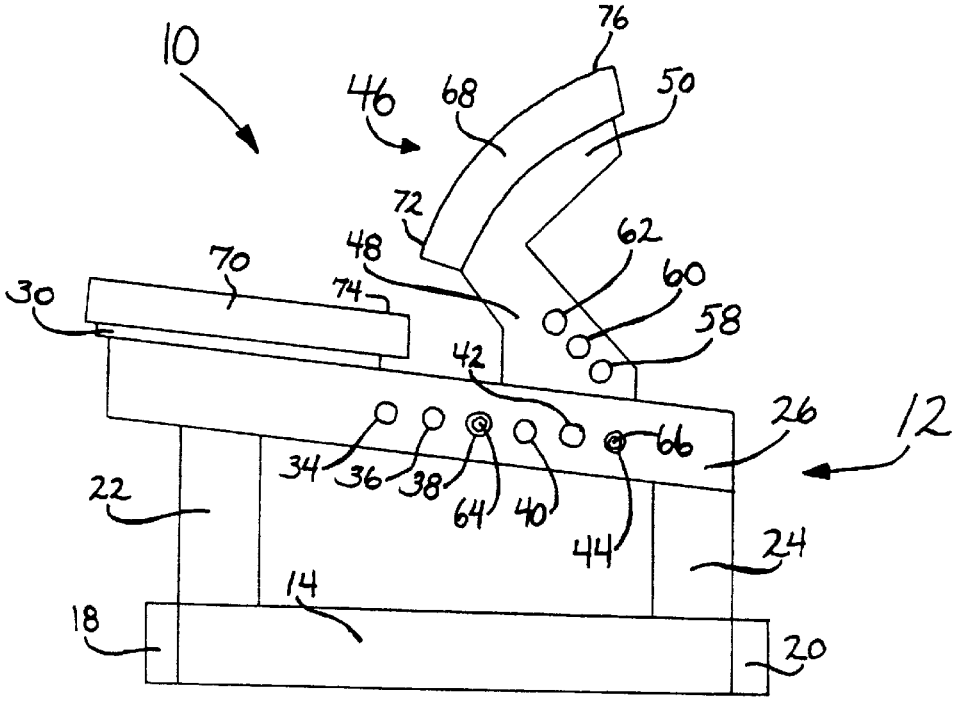
FIG. 2 is a side view of the apparatus of FIG. 1.
Figure 3:
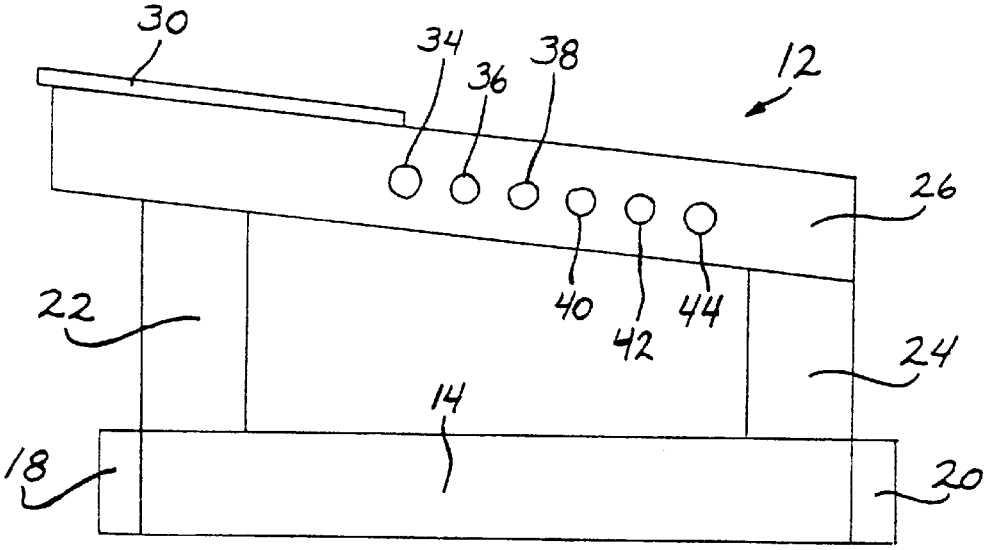
FIG. 3 is a side view of the base frame of the apparatus of the present invention.
Figure 4:
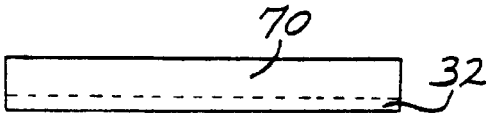
FIG. 4 is a side view of the seat which fits on the base frame of FIG. 3.
Figure 5:
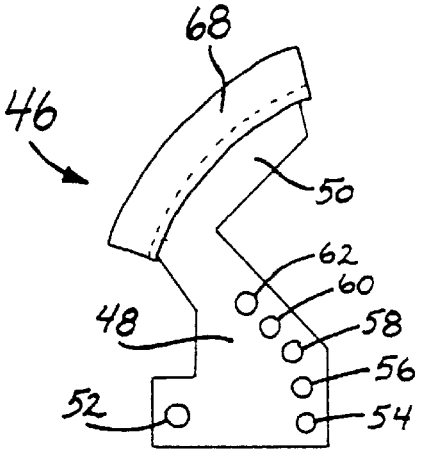
FIG. 5 is a side view of the back support assembly which fits on the base frame of FIG. 3.
Figure 6:
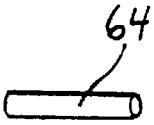
FIG.6 is a view of one of the pins which are used to attach the back support assembly of FIG. 5 to the base support assembly shown in FIG. 3.

With continued reference to FIGS. 2 and 3 a seat support platform 30 is attached to front of the back support assembly mounting members 26, 28, and a seat 32 is attached to the seat support platform 30. The back support assembly mounting members 26, 28 are shown to include a series of holes 34, 36, 38, 40, 42, 44 which are used to retain and adjust the back support assembly 46, which is illustrated in FIGS. 1, 2, and 5. The back support assembly 46 is comprised of a lower portion 48, and a curved upper portion 50. The lower portion 48 includes a pivot hole 52, and a series of back support adjustment holes 54, 56, 58, 60, 62, as shown most clearly in FIG. 5.

As shown in FIG. 1, there is sufficient space between the back support assembly mounting members 26, 28, to form a slot in which to receive the lower portion 48 of the back support assembly 46, therebetween. Retention of the back support assembly is accomplished through the use of a pivot pin 64, and an adjustment pin 66, as shown in FIGS. 1–2. As shown, the pivot 64 is inserted first through hole 34,36,or 38 in one of the back support assembly mounting members 26, then through the pivot hole 52 in the lower portion of the back support assembly 46 (See FIG. 5), and then through the corresponding hole in the second back support assembly mounting member 28. The presence of the pivot pin 64 extending through the holes 34,36,or 38 in the back support assembly mounting members 26, 28, and the pivot hole 52 in the back support assembly 46, retains the back support assembly 46 in position on the apparatus 10. In addition, the pivot pin 64 acts as a pivot point around which the angle of the back support assembly 46 can be adjusted.

To adjust the angle of the back support assembly 46, the adjustment pin 66 is placed through a pair of corresponding holes 40,42, or 44 in the back support assembly mounting members 26, 28 and through one of the adjustment holes 54, 56, 58 60,62 in the back portion of the back support assembly 46. As illustrated in FIGS. 1–2, the adjustment pin extends through adjustment hole 54 in the back support assembly 46.

To adjust the distance of the back support assembly 46 from the seat 32, the back support assembly 46, can be moved between the back support assembly mounting members 26,28 and retained by corresponding placement of pivot pin 64 and adjustment pin 66. For example, to move the back support assembly closer to the seat, pivot pin 64 can be placed through hole 34 and adjustment pin can be placed through hole 40.

With continued reference to FIGS. 1–3 and 5, the curved upper portion 50 of the back support assembly 46 is preferably covered by a padded back support 68, which (in a preferred embodiment) can be comprised of a narrow piece of thin plywood, covered by foam and a rubberized fabric.

As shown in FIGS. 1–2, the padded back support 68 curves upward from its forward portion 72 which is closest to the rearmost portion 74 of the padded seat 70. The rearward portion 76 of the padded back support 68 is furthest away from the seat 70.

In a preferred embodiment of the apparatus 10, the frame members 12, 14, 16, 18, 20, 22, 24, 26, 28 are constructed of wood, while the seat 32 and back support assembly are constructed of plywood. The padded back support 68 and the padded seat 70 are preferably covered by a foam material which, in turn, is covered by a seat covering material which may be a rubberized cloth, vinyl, or any other suitable material.

Figure 7:
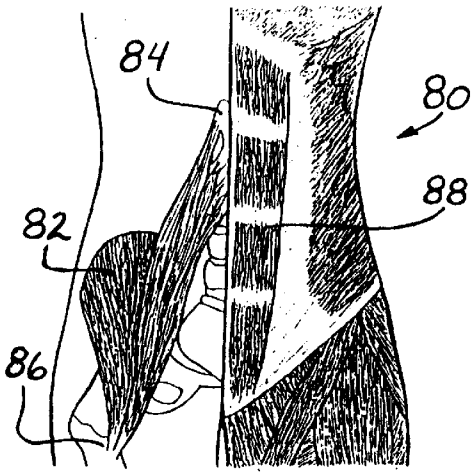
FIG. 7 is a cut away view of a human trunk illustrating the underlying muscles.

In order to appreciate how the apparatus 10 operates, as well as to understand the inventive method described herein, it is necessary to understand how the body is constructed. Accordingly, FIG. 7 illustrates a view of the human trunk 80, showing the two sets of muscles described above. On the left side of FIG. 7 are shown the thigh flexors 82. As illustrated, the thigh flexors 82 are connected to the lower part of the spine 84 and to the upper end of the thigh bone 86. It is this attachment to the lower spine that produces the pressure of the low back when the upper body is raised by the thigh flexor muscles 82.

The abdominal muscles 88 are not used to fold the body. Consequently, in order to exercise and develop the abdominal muscles 88 no benefit is derived from folding the body at the hips. Any effort to develop the abdominal muscles 88 will be more productive when the thigh flexors 82 are eliminated from the exercise effort. Their elimination saves energy and removes the stress and pain which they cause to the lower back.

Figure 9:
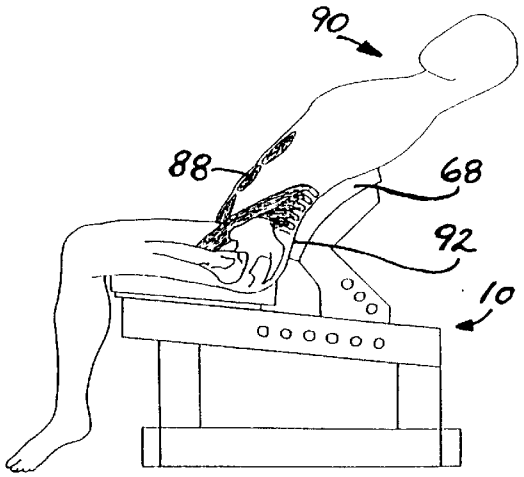
FIG. 9 is a side view of the apparatus of the present invention 1 with the user in a reclined position.
Figure 8:
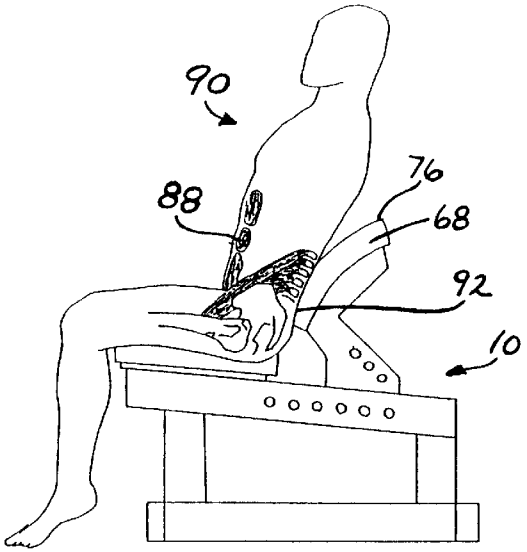
FIG. 8 is a side view of the apparatus of the present invention with a user seated thereon.

Referring to FIGS. 8–9, a person 90 is shown sitting on the padded seat 70 of the exercise apparatus 10 of the present invention. As shown, the person 90 is positioned all the way back on the padded seat 70, so that the lower portion of his back 92 contacts the forward portion 72 of the curved padded backsupport 68 while he is in the upright position (FIG. 8). The contact with the back support 68 prevents the user's body from unfolding at the hips, thereby eliminating the need of the thigh flexors 82. Note, though that when seated upright, the user 90 does not contact the rearward portion 76 of the padded back support 68.

As shown in FIG. 9, when the person 90 lowers the upper body, the back following the curved back support 68 is arched and supported. Gravity is the force lowering the body with the eccentric contraction of the abdominal muscles 88 controlling the movement. The upper body will lower till the abdominal muscles 88 fully extend.

In a preferred embodiment of the invention, the padded back support 68 preferably has a constant curve so the user's back remains fully supported and aligned throughout the movement to the reclining position. Further, the padded curved back support 32 is narrow, so that it fits in the trough of the user's back, best supporting the backbone.

In FIG. 1, the apparatus 10 is shown with the back support assembly 46 in the full "up" position which is the position in which the user experiences the minimum amount of resistance. The back support assembly 46 may be lowered by removing adjustment pin 66 from hole 44 (shown in FIGS. 1–2), and then replacing it through one of the holes 56, 58, 60, 62 which is closer to the curved upper portion 50 of the back support assembly 46. It can also be moved forward (closer to the padded seat 32) to maintain the proper distance between the padded back support 68 and the padded seat 70, so that the small of the user's back can readily make contact with the padded back support 68 while the user 90 is comfortably seated on the padded seat 70.

Thus an inventive exercise performed by a user on the present inventive apparatus that isolates, stretches and works the abdominal muscles without substantial use of the users thigh flexor muscles can comprise the following steps:

(a) The individual 90 sitting substantially upright FIG.8 on a substantially horizontal seat on exercise apparatus 10.

(b) Makes contact between the user's lower back 92 and lower curved upper portion 72 of back support assembly 48 of exercise apparatus 10, curved upper portion of back support 68 having a shape which permits only the forward portion 72 of curved upper portion of back support to contact and support the user's back 92 when the user is seated substantially upright, to prevent the body from unfolding at the hip;

(c) Leaning back from seat 70 onto curved upper portion 68 of back support 48, whereby as the user lowers the upper body FIG.9 over curved upper portion 68 of back support 48, with the force of gravity and with movement controlled by eccentric contraction of the abdominal muscles 88, the back is arched and supported by curved upper portion 68 of back support 48 thereby extending the abdominal muscles 88, and whereby upper body is lowered till abdominal muscles 88 are fully extended.

(d) Then curling the upper body from upper portion 76 of curved upper portion 68 of back support 48 to a substantially contracted position of the abdominal muscles 88, the abs are isolated, stretched, and worked through their full range of motion without substantial involvement of the user's thigh flexor muscles 82,84.

As discussed above, the apparatus 10 of a preferred embodiment of the invention is constructed of wood but any structural material strong enough to support the load can be used. The base frame assembly 12 is preferably constructed in an I-shaped formation, with the center portion of the "I"

being comprised of the lower base members 14, 16 and with the upper and lower portions of the "I" being comprised of the front end member 18 and the rear end member 20, respectively.

When the base frame assembly 12 is made of wood, and assembled as shown large glued areas are formed between the members which create joints capable of supporting the impact load to which the apparatus 10 is subjected.

While the preferred embodiment of the invention has been described, it should be understood that it is not to be limited thereto inasmuch as changes and modifications may be resorted to without departing from the spirit or scope of the invention as defined in appended claims.

For example, the base frame assembly of the preferred embodiment could readily be modified to use a different material, i.e., plastic or metal. Further, it could be modified to include alternative means for supporting the seat and the back support assembly, as well as alternative means for permitting the adjustment of the back support assembly.

I claim:

1. An exercise apparatus comprising:

(a) a base assembly adapted to rest on a floor, comprising (i) a lower base member having a forward end and a rearward end;

(ii) a forward vertical support and a rearward vertical support which vertical supports are mounted on said lower base member, the forward vertical support toward the forward end of said lower base member and the rearward vertical support toward the rearward end of said lower base members; and (iii) a parallel pair of back support assembly mounting members which extend between and are supported by said forward and rearward vertical supports to form a slot between said parallel pair of back support assembly mounting members, said slot adapted to receive a back support assembly therein;

(b) means for supporting a seat on said base assembly;

(c) a substantially horizontal seat mounted on said means for supporting a seat; and (d) a back support assembly having a curved upper portion and a lower mounting portion, said back support assembly being mounted by the lower mounting portion on said base assembly adjacent to said seat, said curved upper portion including a forward portion adjacent to said seat and a rearward portion more remote from said seat than said forward portion, whereby a user of the apparatus can sit on said seat with the small of the user's back in contact with said forward portion of said curved upper portion of said back support while said user is in a substantially upright position, and whereby said user can lean back onto said curved upper portion of said back support while retaining the small of his back in contact with said forward portion of said curved back until said user's entire back makes contact with the entire curved upper portion of said back support, which back support remains stationary during use.

2. The apparatus of claim 1, wherein the base assembly further comprises a pair of end pieces, one attached to the forward end of said lower base member and one attached to the rearward and of said lower base member, forming an "I" configuration.

3. An exercise for a user of an exercise apparatus as claimed in claim 1, which isolates, stretches and works the abdominal muscles of the user without substantial involvement of the user's thigh flexor muscles, comprising the steps of:

(a) sitting substantially upright on the substantially horizontal seat on said exercise apparatus;

(b) making contact between the user's lower back and said curved upper portion of said back support, said curved back support having a shape which permits only the forward portion of said curved upper portion of said back support to contact and support the user's back when the user is seated substantially upright, to prevent the user's body from unfolding at the hip;

(c) leaning back onto said curved upper portion of said back support, whereby the user lowers the upper body over said curved upper portion of said back support, with the force of gravity and with movement controlled by eccentric contraction of the abdominal muscles, whereby the back is arched by said curved upper portion of said back support thereby extending the abdominal muscles, and whereby said upper body is lowered until the abdominal muscles are fully extended; and (d) raising the upper body from said curved upper portion of said back support, thereby isolating, stretching and working the user's abdominal muscles without substantial involvement of the user's thigh flexor muscles.

* * * * *